United States Patent [19]

Weatherholt

[11] 4,354,321

[45] Oct. 19, 1982

[54] SNOW ATTACHMENT FOR A ROAD GRADER

[76] Inventor: Floyd V. Weatherholt, Rte. 3, Box 34A, Rockport, Ind. 47635

[21] Appl. No.: 235,178

[22] Filed: Feb. 17, 1981

Related U.S. Application Data

[63] Continuation-in-part of Ser. No. 7,255, Jan. 29, 1979, abandoned.

[51] Int. Cl.[3] ..... E01H 5/00

[52] U.S. Cl. ..... 37/231; 37/117.5; 37/283; 172/817

[58] Field of Search ..... 37/41, 42 R, 42 VL, 37/50, 117.5; 172/701.1, 810–811, 817, 784, 786, 787, 788, 789, 245, 253

[56] References Cited

U.S. PATENT DOCUMENTS

| | | | |
|---|---|---|---|
| 2,488,695 | 11/1949 | Upton | 37/DIG. 3 |
| 2,891,335 | 6/1959 | Linneman | 172/810 X |
| 3,665,622 | 5/1972 | Lamb | 37/117.5 |
| 4,076,080 | 2/1978 | Anderson | 37/117.5 |

*Primary Examiner*—E. H. Eickholt
*Attorney, Agent, or Firm*—Edwin E. Greigg

[57] ABSTRACT

A snow attachment, as a blade, which may be selectively and readily positioned and secured onto a conventional road grader to permit the latter to provide multi-functional seasonal purposes. The snow blade, which is added to the front of the grader, is operated by hydraulically controlled power arms which normally serve lowering and lifting purposes for a conventional, but now-removed, known scarifier blade.

2 Claims, 3 Drawing Figures

SNOW ATTACHMENT FOR A ROAD GRADER

REFERENCE TO RELATED APPLICATION

This application is a continuation-in-part of application Ser. No. 007,255 filed Jan. 29, 1979 now abandoned.

BACKGROUND OF THE INVENTION

This invention relates to snow removal equipment and more particularly to a simple snow removal blade and assembly for attachment to heavy equipment normally used for other purposes.

As is known, heavy equipment, such as that used for the grading of roadways and associated shoulders, is quite costly and, mostly, has a limited period of usage, depending on the season, the weather and/or particular working conditions. The expense involvement is such that an important significance of the invention is to afford a more yearly usage of the road grading equipment, i.e. not only in the instance of scarifying and earth moving or grading, but for the removal of snow, as well.

Accordingly, the invention provides a multipurpose year-round usage of the heavy equipment, serving not only to justify overall initial purchase expenditures, but also spreading both positive earth/snow working results. Briefly, the invention envisions the removal of the conventional scarifier blade found on a typical road grader. In one invention form, the power arms which formerly controlled upward and downward movement of the scarifier blade are connected to linkage which is a part of the framework for the snow attachment arrangement, or, in the alternative, the lifting arms for the scarifier blade may be moved forwardly of the aforesaid power arms and directly connected to the device of the invention.

In other words, the inventive device functions with the hydraulic control system already available on the grading equipment. Additionally, cooperating pin and opening arrangements, on arms connecting the snow removal blade mounting framework in a telescopic relationship, serve to position the angular setting of the snow blade relative to the linear axis of the grading equipment for the desired end usage. Moreover, the invention may be used in combination with the grader blade, where the latter is powered independently of the system provided for the instant attachment, i.e. that which formerly served lowering and lifting purposes for the scarifier blade. In any event, the aforesaid hydraulic power systems are conventional in form and, for this reason, are not detailed herein.

BRIEF DESCRIPTION OF THE DRAWING

A better understanding of the present invention will become more apparent from the following description, taken in conjunction with the accompanying drawing, wherein.

Figure 1:
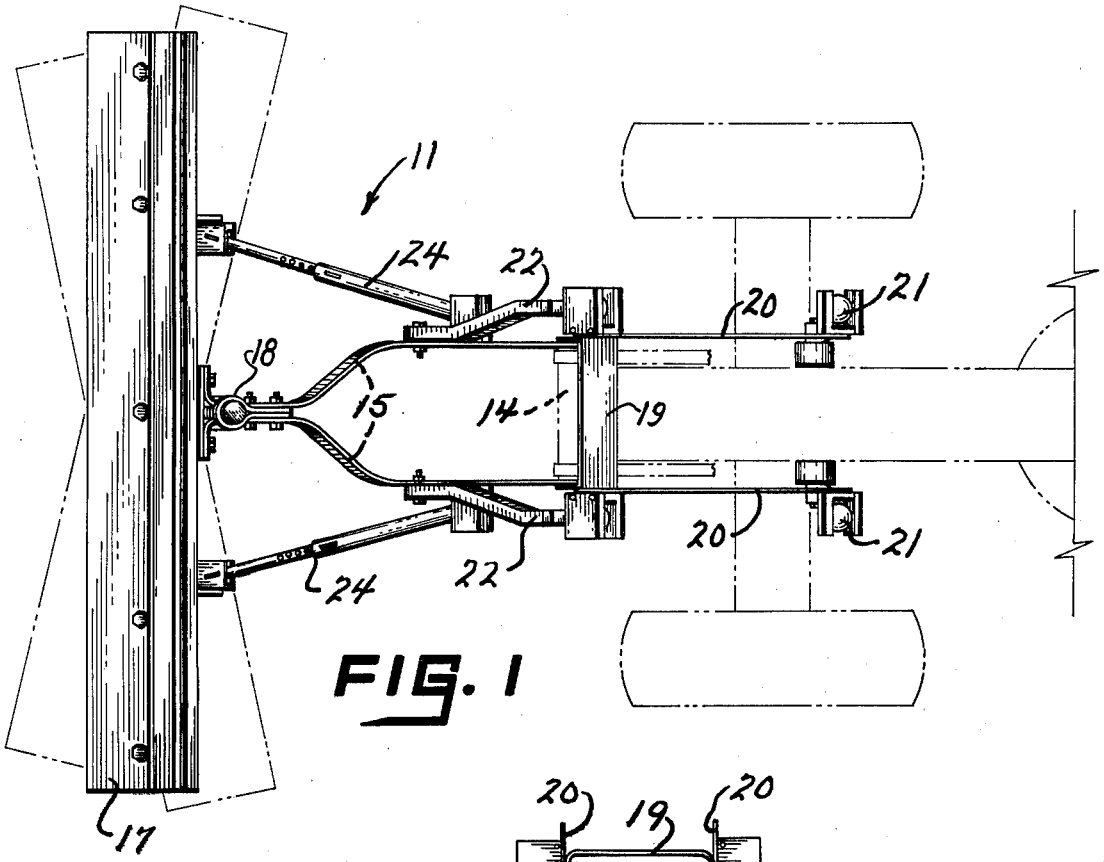
FIG. 1 is a top plan view of the snow attachment of the invention, where a portion of a conventional road grader to which the attachment is secured is shown in phanton.
Figure 3:
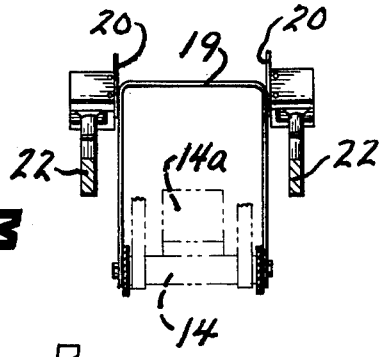

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION

Referring now to the figures, the attachment 11 of the inventive device is selectively and directly mounted onto the front of a conventional road grader. As is known, the known road grading equipment also includes a scarifier blade (not shown), typically having teeth or the like at the lower edge therof, followed by a grader blade (also not shown).

Conventional hydraulically operated power systems play importance in the operation of road grading equipment. In this connection, one system functions in cooperation with the scarifier blade, being represended by power arms 12, on either side of the grader, and connecting longer telescopic type arms (not shown) for lifting purposes. Another power system serves lifting purposes insofar as the grader blade is concerned.

It should be mentioned at this time that in employing attachment 11 of the inventive device, the scarifier blade is removed, but the grader blade may remain. In other words, primary snow plowing as well as secondary snow plowing, the latter by the grader blade, can be simultaneously accomplished through use of the instant snow removal attachment 11.

In a typical arrangement, and before installing the attachment 11, a cylindrical housing 14 is employed for receiving the front shaft of the scarifier blade for pulling purposes. As to cylindrical housing 14, such may be integral with the framework for the road grading equipment or may be secured to a plate member **14*a* which is selectively bolted onto the equipment framework at any desired height location. In any event, in the instance of the invention, the front shaft for the scarifier blade is removed and the telescopic lifting arms in the power system are disconnected. The power arms 12 remain and raise and lower the inventive device by forward and rearward movement of the arm 12**.

Thereafter, a shaft (not evident) for the snow removal attachment 11 of the invention is inserted within the cylindrical housing 14, being retained therein as by pin means (not shown) and included as part of an assembly which includes angularly shaped angling members 15 which are secured to the rear surface of snow blade 17, at the mid-point of its length and is pivotably secured thereto by a hinge-type connection 18. The opposite end of the angling members are pivotably connect to the retaining pin means to which one end of an upstanding yoke or frame 19 is pivotably secured. In other words, the attachment 11 herein is readily mounted on the road grading equipment through existing components.

Figure 2:
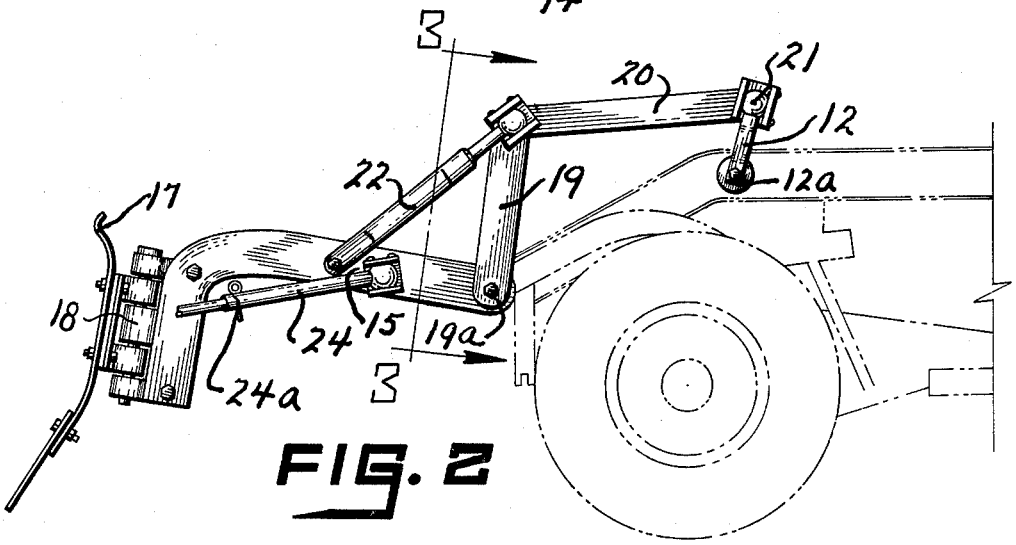
FIG. 2 is a view in side elevation of the invention, detailing certain parts thereof, and also depicted in combination with a road grader shown in phantom; and, FIG. 3 is a view in vertical section, taken at line 3—3 on FIG. 2 and looking in the direction of the arrows, showing other details of the snow removal attachment defining the invention.

The upper corner of each side of the yoke or frame 19 pivotally mounts a linkage 20 which extends rearwardly to a ball and socket joint 21 or any other suitable type connection interconnecting the power arms 12 which formerly served scarifier blade power purposes. In the depicted arrangement, the linkages 20 are each a separate component, but, in the alternative, such can be the aforesaid telescopic lifting arms for the power system for the scarifier blade, after being moved upwardly and rearwardly to connect with the frame or yoke 19. Stationary members 22 extend between the angling members 15 and the aforesaid corners of the yoke or frame 19, providing rigidity in use. The arms connect to angling members 15 by use of a pin or bolt and are pivotable about the pin or bolt. The opposite ends of arms 22 are shown pivotably connected to the ends of yoke 19 and linkages 20 by a ball and socket or any other suitable type connection. This end may also be connected by a pin or bolt which allows relative movement of the connected parts. The arm 22 is not adjustable in length, therefore it may be flat or rectangular in cross-section as shown in FIG. 1 or round as shown in FIG. 2. The particular shape is not critical so long as members 22 are fixed in length.

Telescopic members 24 extend from the outer surfaces of the angling members 15 to the rear surface of the snow removal blade 17 to which they are connected equidistant from and outwardly of the central pivot point of the blade 17 to which the anguling members are secured at 18. The angling members are secured together at their blade connecting end and one-half of the hinge 18 is secured to the connected ends of the angling members with the other half of the hinge secured to the blade. Pins and cooperating openings 24*a* are provided in the telescopic members 24 for shortening and lengthening purposes. In other words, telescopic members 24 control the operational angular setting of snow removal blade 17, sample variations of which are typically represented by phantom lines in FIG. 1. It might be noted that ball and socket joints (not shown) may alternatively be employed to secure the telescopic members 24 to the snow blade 17.

In other words, and basically, the invention readily permits the selective attachment of a snow blade 17 to the front of a road grader. The snow blade 17 itself is typical in configuration and, as stated, is susceptible to directional changes during usage, depending upon snow conditions. The power arms 12, formerly used with the now-removed scarifier blade, through pivotal movements at joints 12*a* and 19*a*, cause the raising and lowering of the overall snow blade assembly defining the invention, basically through linkage 20 and stationary interconnecting members 22. Restated, simple pivotal movement readily achieves the raising and/or lowering of the attachment 11 for usage. In raising the blade, the angling members pivot about the pin in the cylindrical housing 14 and the blade is raised by members 22 and linkages 20 as the lever 12 is moved rearward. The blade is likewise lowered by movement of the lever 12 forward. Without departing from the spirit of the invention, the arms 12 could be pivotally connected to the frame and arms connected at 21 connect with a power operated cylinder or lever or the end of power cylinder could be connected at 21 which would cause the angling members 15 to pivot about the pin through cylindrical housing 14.

As stated, the grader blade (not shown) may also be used to implement the invention, noting that the grader blade is powered separately from that for the scarifer blade. Thus, the invention provides for additional and/or seasonal usage of expensive road grading equipment, representing effective end usage and selective ready installation to the type of heavy equipment commonly in use.

The preceding snow attachment arrangement is susceptible to various changes within the spirit of the invention, as, for example, the manner of supporting the snow blade, the particular approach utilized for moving the snow blade in a particular direction, the usage of alternative linkage between the power arms and the yoke or frame of the attachment of the alternative usage of the telescopic lifting arms for this purpose, i.e. those formerly used in connection with the scarifier blade, and the like. Thus, the preceding description should be considered illustrative and not as limiting the scope of the following claims:

What is claimed and desired to be secured by Letters Patent of the United States is:

1. A simple snow removal blade and snow blade assembly for attachment to a road grading equipment and to its lifting and lowering controls for converting said grading equipment to a snow removal device which comprises:

a snow removal blade, having a front side and a backside;

angling members pivotably secured at one end to the back side of said snow removal blade at its center linearly;

pivot means securing said one end of said angling members to the back side of said snow removal blade;

means for connecting said angling members to the front end of said road grading equipment;

yoke means extending upwardly with its lower ends pivotably connected to said means for connecting said angling members to said road grader;

non-extendable members connected at one end to said angling members at a point between said snow removal blade and said means for connecting said angling members to said grading equipment and pivotably connected at their opposite end to the upper end of said yoke means;

linkage means connected at one end to the upper end of said yoke and extending from said yoke with its opposite ends connected to a power control means on said grader equipment;

a pair of mechanical telescopic members pivotably connected at one end to one each of said angling members at a point nearer said end which connects to said grader than the end which connects with said snow removal blade;

said pair of mechanical telescopic members pivotably connecting at their other end to the back side of said snow removal blade at a point equidistant from said pivot means to which said angling members are pivotable secured;

whereby said angling members and said yoke can be secured to the front end of said grader equipment thereby securing said snow removal blade for removing snow and said linkage means are connected to the power means for raising and lowering said snow removal blade.

2. A simple snow removal blade and assembly as claimed in claim 1 wherein:

each of said mechanical telescopic members are adjustable by use of a removable pin;

whereby the snow removal blade may be set at any desired angle relative to the linear axis of the grader equipment.

* * * * *